US008147913B2

(12) United States Patent
Chang et al.

(10) Patent No.: US 8,147,913 B2
(45) Date of Patent: Apr. 3, 2012

(54) SURFACE TREATMENT METHOD FOR MAGNESIUM ALLOY

(75) Inventors: Shih-Ying Chang, Banciao (TW); Hsien-Hsueh Lee, Danshuei Township, Taipei County (TW); Wei-Shen Chen, Banciao (TW); Yi-Yuan Ke, Shengang Township, Changhua County (TW)

(73) Assignee: National Yunlin University of Science & Technology, Yunlin County (TW)

( * ) Notice: Subject to any disclaimer, the term of this patent is extended or adjusted under 35 U.S.C. 154(b) by 492 days.

(21) Appl. No.: 12/382,260

(22) Filed: Mar. 12, 2009

(65) Prior Publication Data

US 2010/0080918 A1 Apr. 1, 2010

(30) Foreign Application Priority Data

Sep. 30, 2008 (TW) ..... 97137490 A

(51) Int. Cl.
*B05D 3/00* (2006.01)

(52) U.S. Cl. ..... 427/328; 427/327; 427/372.2; 427/383.1; 148/95; 148/240; 148/275

(58) Field of Classification Search ..... 427/327, 427/328

See application file for complete search history.

(56) References Cited

U.S. PATENT DOCUMENTS 4,292,208 A * 9/1981 Baldi et al. ..... 502/338
2006/0134453 A1 * 6/2006 Kuwabara et al. ..... 428/658

FOREIGN PATENT DOCUMENTS

GB 2376693 A * 12/2002
JP 2005068516 A * 3/2005

* cited by examiner

*Primary Examiner* — David Turocy
(74) *Attorney, Agent, or Firm* — Rosenberg, Klein & Lee

(57) ABSTRACT

The present invention provides a surface treatment method for magnesium alloy, which comprising the following steps: 1) preparation; 2) fusion and uniformly coating; 3) heat diffusion, and 4) finish; so a coating alloy is placed on a magnesium alloy substrate, and the magnesium alloy substrate is heated so that the coating alloy is uniformly melted on the magnesium alloy substrate; when heating up to a preset temperature, the coating alloy generates heat diffusion on the magnesium alloy substrate; the coating alloy finally forms a corrosion-resistant hard layer on the magnesium alloy substrate. So, this invention features simple treatment process, stable structure and environmental-friendliness in a wide range of applications.

2 Claims, 6 Drawing Sheets

SURFACE TREATMENT METHOD FOR MAGNESIUM ALLOY

BACKGROUND OF INVENTION

1. Field of the Invention

The present invention relates generally to a surface treatment method for magnesium alloy, and more particularly to an innovative one which features simple treatment process, stable structure and environmental-friendliness in a wide range of applications.

2. Description of Related Art

Due to high activity of magnesium alloy, a loose and porous layer of magnesia is easily formed on its surface, especially in an acid or alkaline environment. So, chemical surface treatment, anodization, vapor deposition process, non-current electroplating or electroplating shall be required to improve the corrosion resistance of magnesium alloy.

With respect to chemical surface treatment, chromate, phosphate or manganate are employed to form a corrosion-resistant metal compound (treatment layer) on the surface of magnesium alloy; but these common toxic solutions and waste liquids will lead to serious environmental pollution.

Moreover, the soft and thin treatment layer subject to chemical treatment can only be taken as an intermediate layer of magnesium alloy, other than a corrosion-resistant surface layer.

If anodization is adopted, the porous and extremely loose magnesium alloy oxiding layer has poorer resistance against corrosion.

The physical or chemical vapor depositions must be conducted under special environmental conditions, but this requires a higher manufacturing cost and strict control while it is difficult to form a thick cladding.

In addition, since magnesium alloy has −2.36V standard reducing potential and higher chemical activity, magnesia (MgO) is easily formed in the atmosphere. Thus, no satisfactory cladding, or even no cladding can be gained by electroplating or non-current electroplating.

If Sn and Zn are electroplated onto the surface of magnesium alloy, the surface is subject to low-temperature heat diffusion (about 190° C.). Sn and Zn can form intermetallic substances such as $Mg_2Sn$ with magnesium. However, Sn and Zn must be firstly adhered onto the surface of magnesium alloy by means of electroplating, leading to poorer adhesion of magnesium alloy electroplating layer. Moreover, owing to different reducing potentials of Sn and Zn, the coating of complex alloy is difficult, and multiple electroplating processes also increase the manufacturing process and complexity.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

SUMMARY OF THE INVENTION

The main objective of the present invention is to provide a surface treatment method for magnesium alloy, which features simple treatment process and stable structure.

The secondary objective of the present invention is to provide a surface treatment method for magnesium alloy, which can be used in a broad market.

Another objective of the present invention is to provide a surface treatment method for magnesium alloy, which will not cause any negative impact on the environment.

The present invention provides a surface treatment method for magnesium alloy, which includes the following steps:

1. Preparation;
2. Fusion and uniformly coating;
3. Heat diffusion; and
4. Finish.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
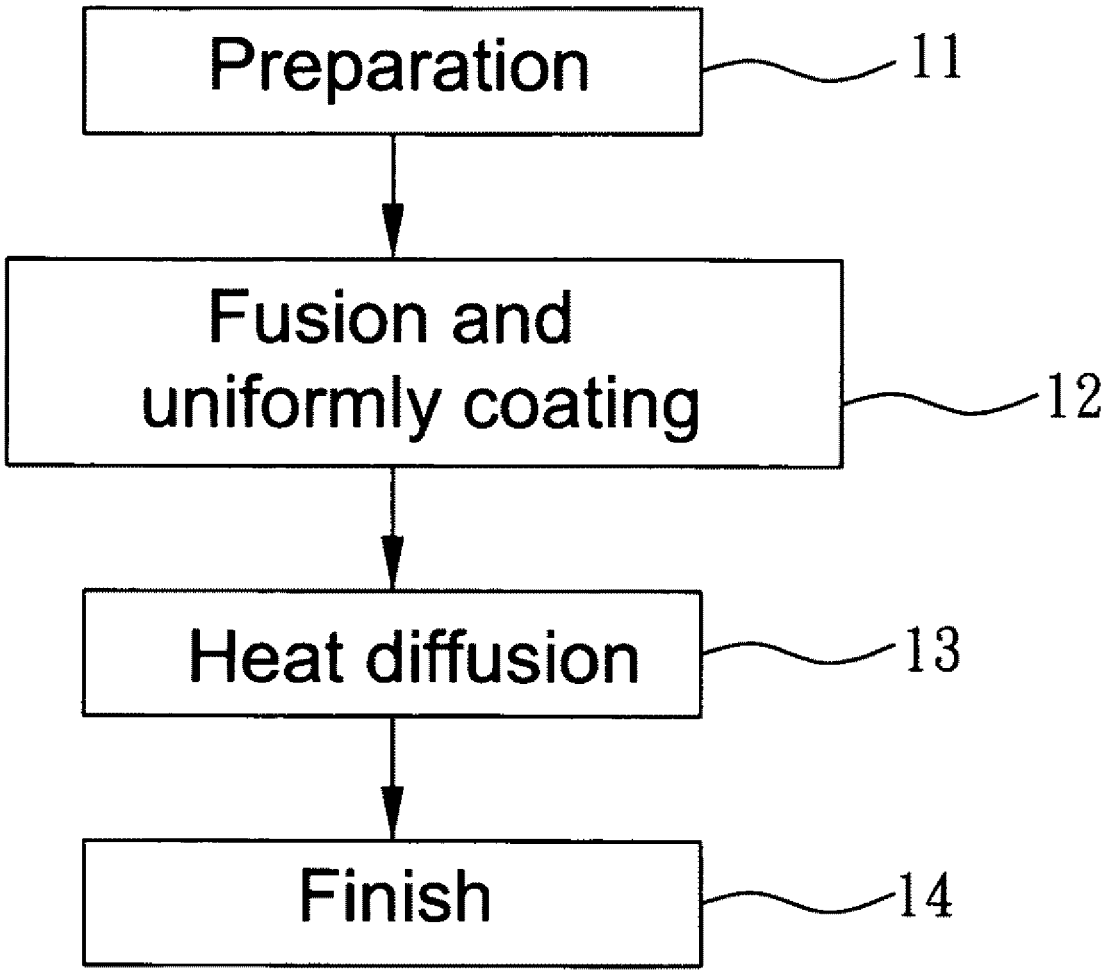
FIG. 1 depicts a flow process chart of the present invention.
Figure 2:
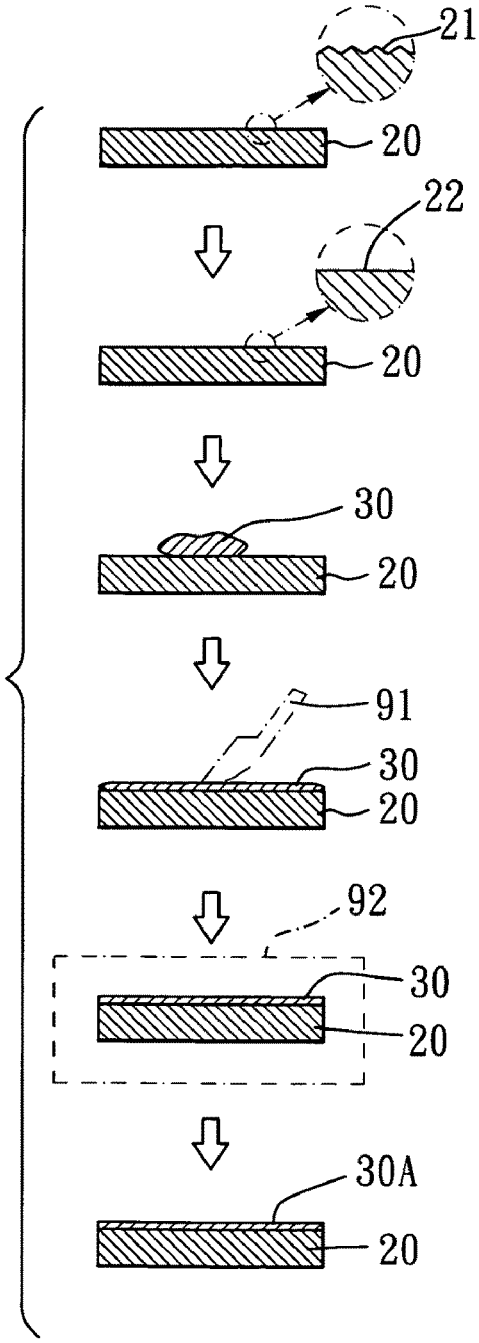
FIG. 2 depicts a schematic view of the treatment process of the present invention.
Figure 3A:
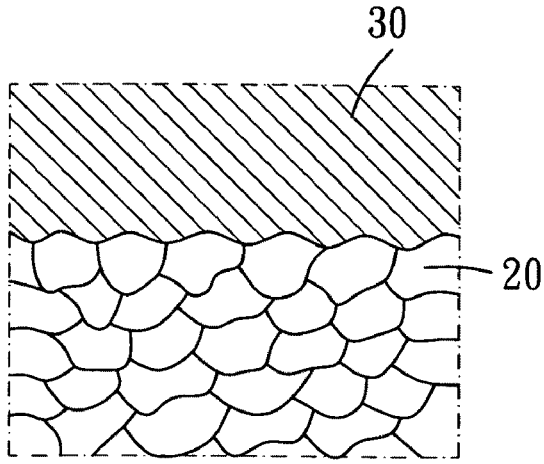
FIGS. 3A, 3B, 3C depict a partially enlarged view of FIG. 2 wherein the coating alloy is subject to heat diffusion on the magnesium alloy substrate
Figure 3B:
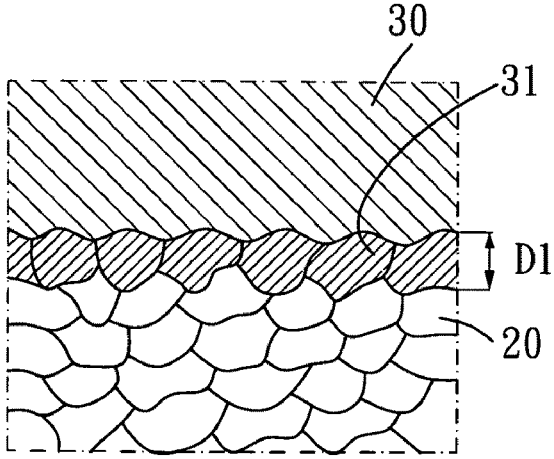
Figure 3C:
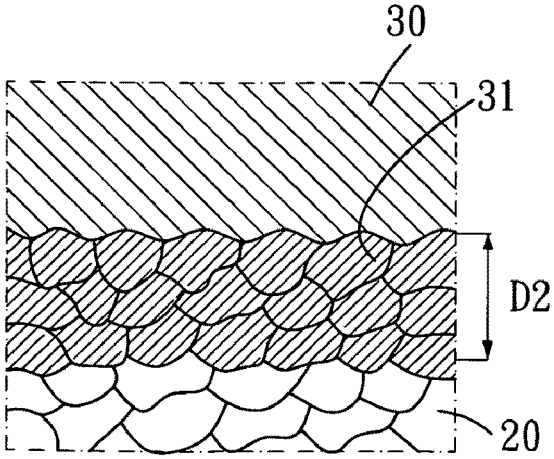
Figure 4:
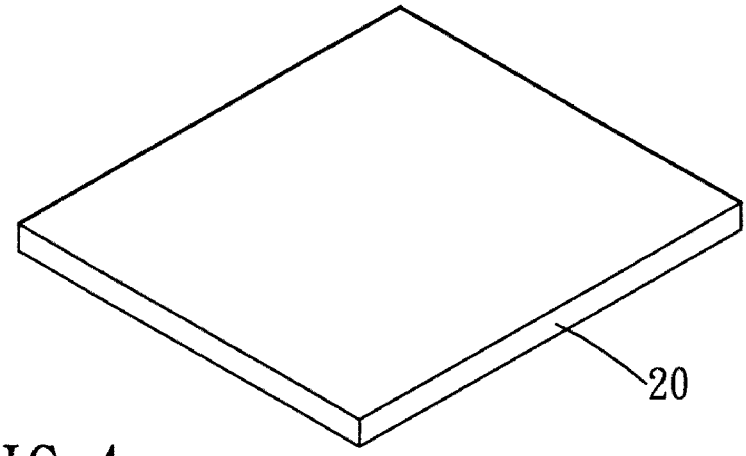
FIG. 4 depicts an outside view of magnesium alloy substrate in FIG. 2.
Figure 5:
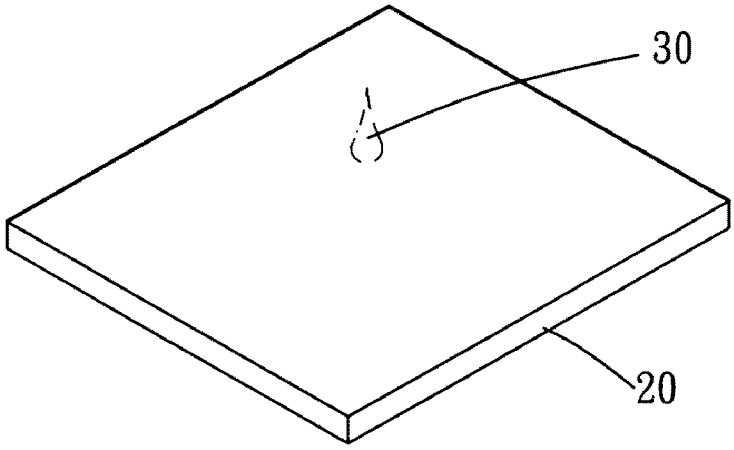
FIG. 5 depicts a schematic view of FIG. 2 wherein the coating alloy is arranged on the magnesium alloy substrate.
Figure 6:
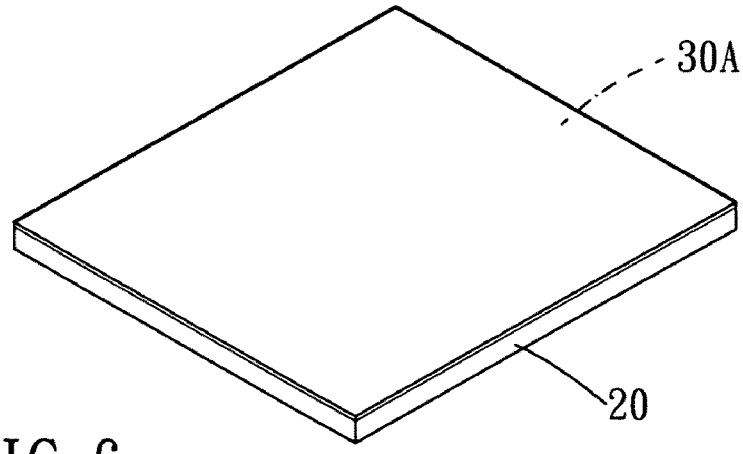
FIG. 6 depicts a schematic view of magnesium alloy substrate in FIG. 2 after completion of surface treatment.

Referring to FIGS. 1 and 2, the surface treatment method of the present invention for a magnesium alloy includes the following steps:

1) Preparation 11: prepare a magnesium alloy substrate 20 (shown in FIG. 4) and a coating alloy 30, of which the coating alloy 30 is of low-temperature active structure with melting point less than that of the magnesium alloy substrate 20;

2) Fusion and uniformly coating 12: place the coating alloy 30 on the magnesium alloy substrate 20 (shown in FIG. 5), heat up the magnesium alloy substrate 20 and coating alloy 30; when the coating alloy 30 is melted, it is uniformly coated on the magnesium alloy substrate 20;

3) Heat diffusion 13: when it is heated up to a preset temperature, the coating alloy 30 is diffused on the magnesium alloy substrate 20 (as shown in FIGS. 3A, 3B and 3C), and generates reaction with the magnesium alloy substrate 20;

4) Finish 14: the coating alloy 30 finally forms a corrosion-resistant hard layer 30A on the magnesium alloy substrate 20 (shown in FIG. 6).

In practice, use AZ31 magnesium alloy substrate 20 during the process of preparation 11, and pre-grind the coarse surface 21 of magnesium alloy substrate 20 into a smooth surface 22 (shown in FIG. 2) with abrasive paper.

The coating alloy 30 can be prepared by melting under vacuum or protective environment; and the coating alloy 30 is selected from Sn—Zn or Sn—Zn—Al; moreover, a rare-earth (including: La, Ce, Pr, Nd, Pm, Sm, Eu, Gd, Tb, Dy, Ho, Er, Tm, Yb, Lu, Y and Sc, collectively referred to as "RE") can be added at a minimum; then Sn—Zn—RE and Sn—Zn—Al—RE are formed separately, with the percentage (in weight %) listed in Table 1:

TABLE 1

| | Element | | | |
|---|---|---|---|---|
| Alloy | Sn | Zn | Al | Rare-earth(RE) |
| Sn—Zn | Residual | 5~50(%) | — | — |
| Sn—Zn—Al | Residual | 5~40(%) | 3~10(%) | — |
| Sn—Zn-RE | Residual | 5~50(%) | — | 0.05~5(%) |
| Sn—Zn—Al-RE | Residual | 5~40(%) | 3~10(%) | 0.05~5(%) |

In the fusion and uniformly coating 12, a heater 92 (e.g. electric hot plate or heating furnace) is used to heat up the magnesium alloy substrate 20 to a preset temperature (e.g. 250° C., preferably 20~30° C. over the melting temperature of the coating alloy 30), and a scraper 91 is used to apply the coating alloy 30 uniformly on the magnesium alloy substrate 20.

The scraper 91 is made of stainless steel, aluminum, steel, damp-proof ceramic and Polytetrafluoroethylene (PTFE), also known as TEFLON®. With poor heat conductivity, it does not generate reaction with the coating alloy 30.

In the heat diffusion 13, when reaching the preset heat treatment temperature (e.g. lower than 200° C., preferably 5~10° C. lower than the melting temperature of the coating alloy 30), the coating alloy 30 begins to form a reaction layer 31 on the magnesium alloy substrate 20 (shown in FIGS. 3A and 3B, indicating the magnesium alloy substrate 20 and the coating alloy 30 begin diffusion and then form a reaction layer 31 of the first thickness D1); the thickness of the reaction layer 31 on the magnesium alloy substrate 20 will be gradually increased along with the diffusion reaction (shown in FIG. 3C, it is assumed the first thickness D1 increases to the second thickness D2).

After Finish 14, the coating alloy 30 is heated about 1~10 h under heat treatment temperature to establish a reaction bond on the surface of magnesium alloy substrate 20, and then form corrosion-resistant hard layer 30A.

Figure 7:
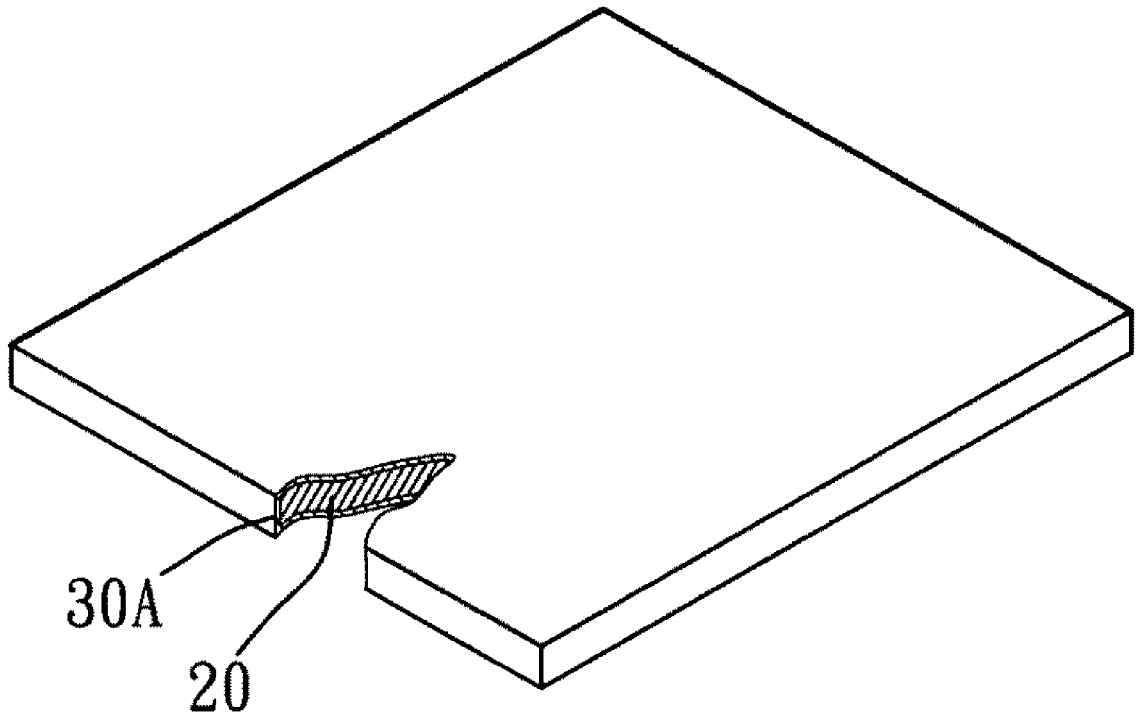
FIG. 7 depicts a schematic view of the present invention that the coating alloy is covered on the magnesium alloy substrate.

Of course, the coating alloy 30 can be fully covered on the magnesium alloy substrate 20 (shown in FIG. 7) without departing from the scope of the invention.

After completion of treatment, the hard layer 30A on the magnesium alloy substrate 20 presents at least corrosion to resistance, abrasion, stronger bonding force and conduction of electricity/heat for smooth melting, electroplating or non-current electroplating.

Figure 8A:
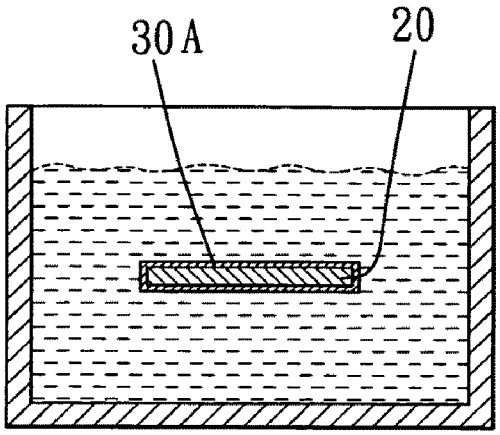
FIGS. 8A, 8B, 8C, 8D depict a comparison view of the corrosion process of two magnesium alloy substrates with/without surface treatment.
Figure 8B:
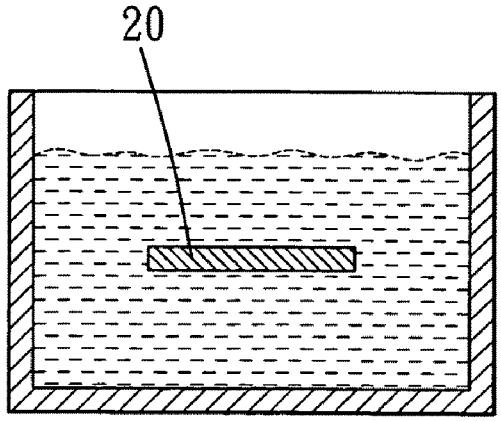
FIG. 8B (PRIOR ART)
Figure 8C:
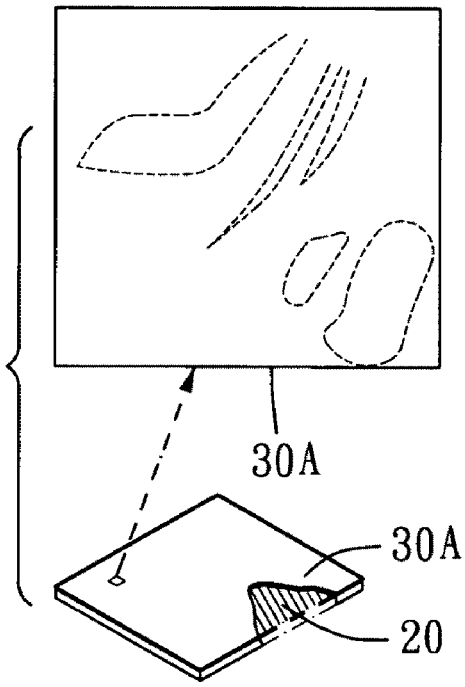
Figure 8D:
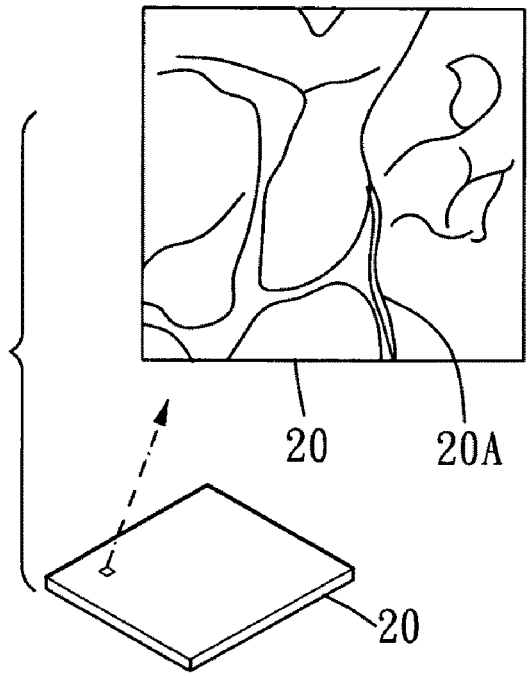
FIG. 8D (PRIOR ART)
Figure 9A:
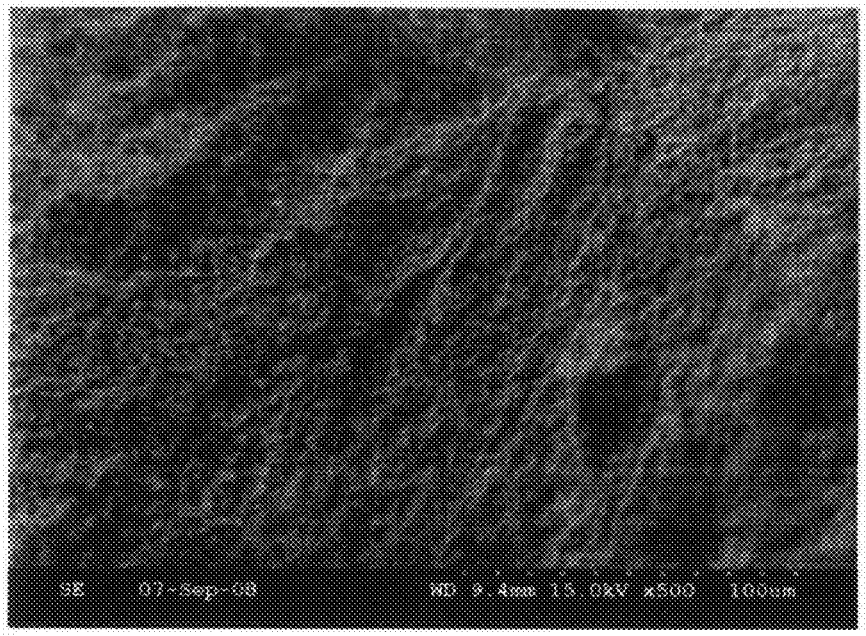
FIG. 9A shows the microscopic structure of magnesium alloy substrate after brine corrosion, which is subject to the surface treatment method of the present invention.
Figure 9B:
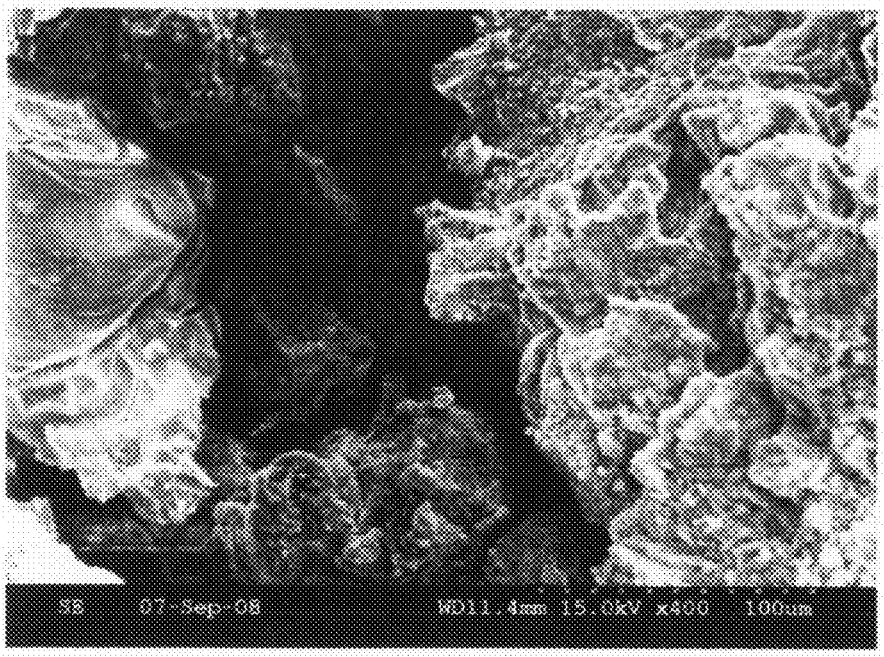
FIG. 9B (PRIOR ART)
FIG. 9B shows the microscopic structure of magnesium alloy substrate after brine corrosion, which is not subject to the surface treatment method of the present invention.

Take a corrosion resistance test for example, in the 5% sodium chloride solution, dip the magnesium alloy substrate 20 with hard layer 30A (shown in FIG. 8A)/without hard layer 30A (shown in FIG. 8B) for 50 hours, and then take to observe the corrosion result by a microscope. Users can find that the microscopic structure of the magnesium alloy substrate 20 with hard layer 30A keeps almost intact after corrosion, except a little injury on the surface of hard layer 30A (shown by the broken line in FIG. 8C; also see FIG. 9A), but that of magnesium alloy substrate 20 without hard layer 30A is seriously corroded, i.e. many large-area corroded portion 20A exist on the surface of the magnesium alloy substrate 20 (shown by the solid line in FIG. 8D; also see FIG. 9B). This proves that the surface treatment method of the present invention for the magnesium alloy provides excellent corrosion resistance.

As a whole, the advantages and efficacies of the present invention are concluded below:

[1] Simple treatment process and stable structure. If the coating alloy is placed on the magnesium alloy substrate under common atmospheric pressure, it can be turned into the hard layer on the magnesium alloy substrate through fusion and heat diffusion (with variable temperature and time) in a very simple way.

[2] A wide range of applications. The present invention features corrosion to resistance, abrasion, stronger bonding force and conduction of electricity/heat for smooth melting, electroplating or non-current electroplating. So, it can be widely applied to hi-tech parts such as: the housings of notebook computers and mobile phones as well as the components of mobile phones; or to the structures even in a corrosive environment, for instance: spare parts of vehicles, industrial machines, material handling and printing equipments.

[3] Environmental-friendliness. The chemical surface treatment, anodization, vapor deposition process, non-current electroplating or electroplating, are not required for the present invention in order to avoid any environmental pollution arising from disposal of toxic and waste solutions.

Although the invention has been explained in relation to its preferred embodiment, it is to be understood that many other possible modifications and variations can be made without departing from the spirit and scope of the invention as hereinafter claimed.

The invention claimed is:

1. A surface treatment method for the magnesium alloy, which includes the following steps:

(a) preparation: preparing a magnesium alloy substrate and a coating alloy, of which the coating alloy is of low-temperature active structure with melting point less than that of the magnesium alloy substrate;

(b) fusion and uniformly coating: placing the coating alloy on the magnesium alloy substrate, heating up the magnesium alloy substrate and coating alloy, so that when the coating alloy is melted, it is uniformly coated on the magnesium alloy substrate;

(c) heat diffusion: heating up to a preset temperature, the coating alloy being diffused thermally on the magnesium alloy substrate;

(d) finish: the coating alloy finally forming a corrosion-resistant hard layer on the magnesium alloy substrate;

wherein:

during the process of fusion and uniformly coating:

a heater is used to heat up the magnesium alloy substrate to a preset temperature, and a scraper used to apply the coating alloy uniformly on the magnesium alloy substrate;

the scraper is made of stainless steel, aluminum, steel, damp-proof ceramic and Polytetrafluoroethylene (PTFE); with poor heat conductivity, it does not generate reaction with the coating alloy;

during the process of heat diffusion:

under the heat treatment temperature lower than 200° C., the coating alloy begins diffusion and generations reaction with the magnesium alloy substrate.

2. The method defined in claim 1, wherein:

the heater is selected from either of electric hot plate or heating furnace;

the coating alloy is heated up to about 20~30° C. over the melting temperature of the coating alloy;

the coating alloy begins diffusion and generates reaction with the magnesium alloy at about 5~10° C. lower than the melting temperature of the coating alloy.

* * * * *